United States Patent [19]

Takahashi

[11] Patent Number: 5,002,498

[45] Date of Patent: Mar. 26, 1991

[54] CARD-EDGE CONNECTOR

[75] Inventor: Hisafumi Takahashi, Tama, Japan

[73] Assignee: Kel Corporation, Tokyo, Japan

[21] Appl. No.: 417,223

[22] Filed: Oct. 4, 1989

[30] Foreign Application Priority Data

Oct. 5, 1988 [JP] Japan ..... 63-130839[U]

[51] Int. Cl.[5] ..... H01R 13/62

[52] U.S. Cl. ..... 439/326; 439/328; 439/341

[58] Field of Search ..... 439/325, 326, 327, 328, 439/329, 341, 342, 343, 629, 630

[56] References Cited

U.S. PATENT DOCUMENTS 4,826,446 5/1989 Juntwait ..... 439/341 X
4,838,806 6/1989 Igarashi ..... 439/341

FOREIGN PATENT DOCUMENTS 2385238 11/1978 France ..... 439/267
2472855 7/1981 France ..... 439/325

*Primary Examiner*—Neil Abrams
*Assistant Examiner*—Khiem Nguyen
*Attorney, Agent, or Firm*—Nilsson, Robbins, Dalgarn, Berliner, Carson & Wurst

[57] ABSTRACT

A card-edge connector comprising a housing having a circuit-board insertion groove having both ends and formed in the wall face. A contact is fixedly inserted in the contact holes of the housing, so that an end of a circuit board is inserted in the contact. The circuit board is electrically connected to the contact when it is rotated to a position substantially perpendicular to the wall face and is held by the circuit-board holding members of the housing after the circuit board has been inserted slantwise in the circuit-board insertion groove. First lift preventing means and second lift preventing means are provided at the respective ends of the circuit-board insertion groove so as to prevent the circuit board from lifting from the housing. First and second locking members for preventing the circuit board from moving back and forth, leftward and rightward, are provided at the respective ends of the circuit-board insertion groove they have engaging step portions disposed so as to face the respective circuit-board holding members. Operating members are provided on the first and second locking members, for broadening a space between the first and second locking members to release the circuit board from the housing.

7 Claims, 7 Drawing Sheets

CARD-EDGE CONNECTOR

BACKGROUND OF THE INVENTION

1. Field of the Invention

This invention relates to a card-edge connector which is detachably and electrically connected to a circuit board such as single memory modules.

2. Description of the Related Art

FIG. 8 shows an example of the conventional connectors for single memory modules.

When a printed board of a memory module (not shown) or the like is fully inserted in a printed board insertion groove 2 formed in that housing 1 of the connector which is made of an electrical insulator, engaging portions 8 for engaging the printed board are fitted in engaging portion receiving holes formed in the printed board. At the same time, both side portions of the printed board are held between engaging pieces 7 and locking pieces 4. Thus, the printed board is securely fixed to the housing 1. The connector is provided with a plurality of contact insertion holes 3 which are arranged adjacent to the printed board insertion groove 2 and in which contacts (not shown) are provided.

When the fixed printed board must be removed from the printed board insertion hole 2 by some reason, such very undesirable process is required that the user pushes outward both the stop locking pieces 4 with the nails or he uses a tool such as a driver to push the pieces 4 outward. Accordingly, the circuit board cannot be easily and safely removed from the connector.

SUMMARY OF THE INVENTION

The object of this invention is to provide a card-edge connector from which a circuit board is easily and safely removed.

This invention provides a card-edge connector which comprises:

a housing having a wall face, a circuit-board insertion groove having both ends and formed in the wall face, a plurality of contact holes arranged adjacent to the circuit-board insertion groove a first circuit-board holding member, and a second circuit-board holding member provided at the respective ends of the circuit-board insertion groove on the wall face and said contact holes;

a contact fixedly inserted in the contact holes and having an end of a circuit board inserted therein;

first lift preventing means and second lift preventing means provided at the respective ends of the circuit-board insertion groove, for preventing the circuit board from lifting from the housing;

a first locking member and a second locking member for preventing the circuit board from moving back and forth, leftward and rightward, the first and second locking members being provided at the respective ends of the circuit-board insertion groove and having engaging step portions disposed so as to face the respective circuit-board holding members; and operating members provided on the first and second locking members, for broadening a space between the first and second locking members to release the circuit board from the housing.

The provision of the first and second operating members on the first and second locking members enable the circuit board to be easily and safely removed from the connector.

BRIEF DESCRIPTION OF THE DRAWINGS

This invention can be fully understood from the following detailed description with reference to accompanying drawings in which.

DETAILED DESCRIPTION OF THE PREFERRED EMBODIMENTS

Figure 1:
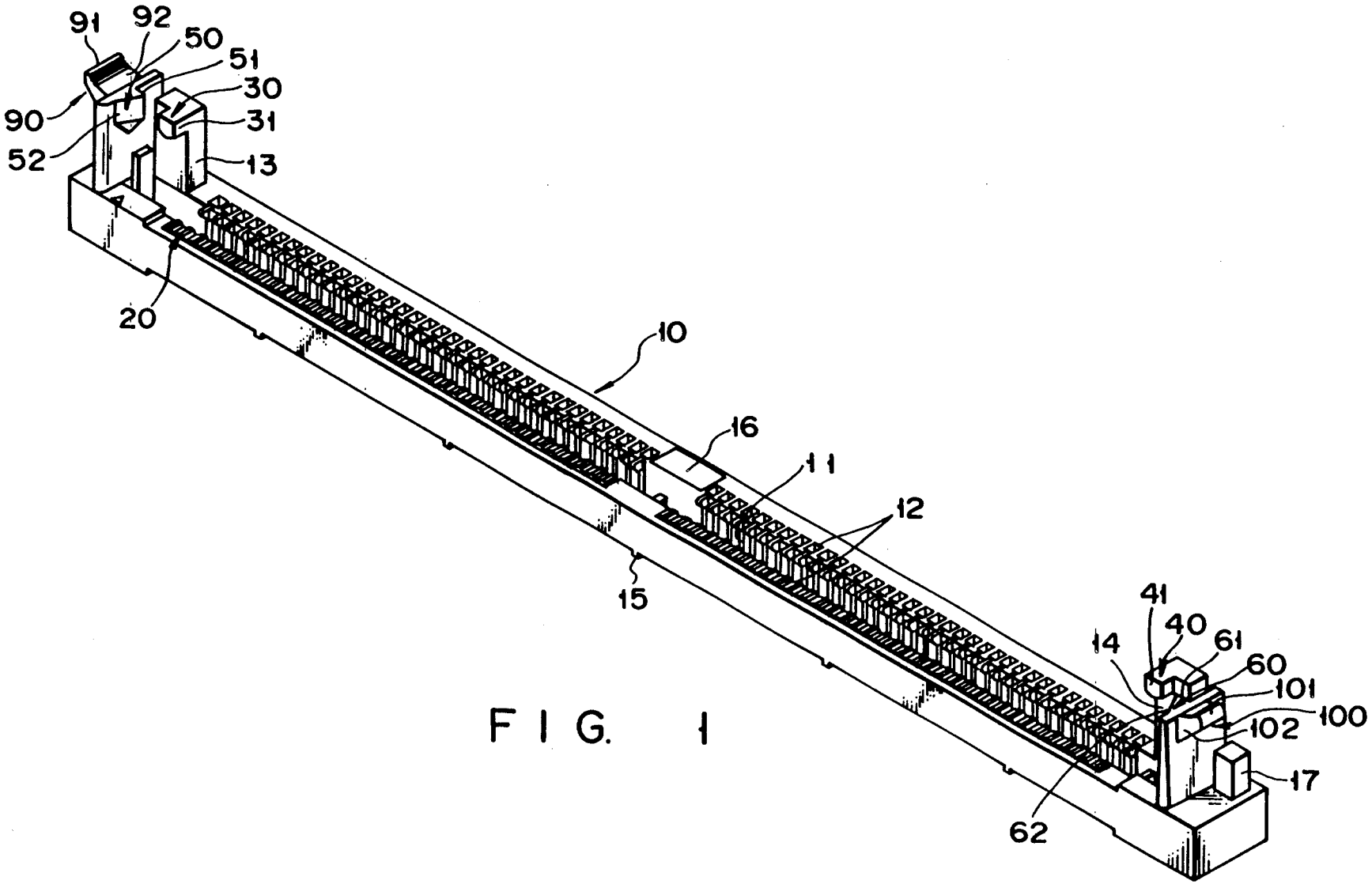
FIG. 1 is a perspective view of a first embodiment of the card-edge connector according to this invention in which a circuit board is not inserted.

The first embodiment of this invention will be explained with reference to FIGS. 1 to 5. A connector comprises a housing 10 made of an electrical insulator, a contact 20 (FIGS. 4 and 5) made of electrically conductive material, a first lift preventing means 30, a second lift preventing means 40, a first locking member 50, a second locking member 60, a first operating member 90 and a second operating member 100.

In the upper face of the rectangular parallelepiped housing 10 is formed a circuit-board insertion groove 11 extending in the lengthwise direction of the housing 10. In the bottom of the circuit-board insertion groove 11 are formed a plurality of contact insertion holes 12 so as to extend perpendicularly to the bottom. On the respective ends of the circuit-board insertion groove 11 are formed first and second circuit-board holding members 13 and 14 having a square pillar shape.

Figure 4:
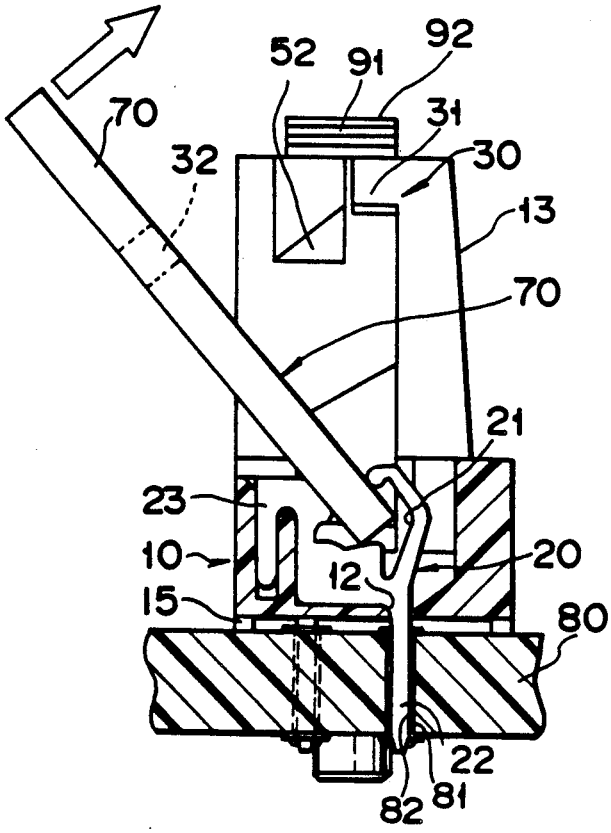
FIGS. 4 and 5 show how a circuit board is inserted in the housing of the connector of FIG. 1.
Figure 5:
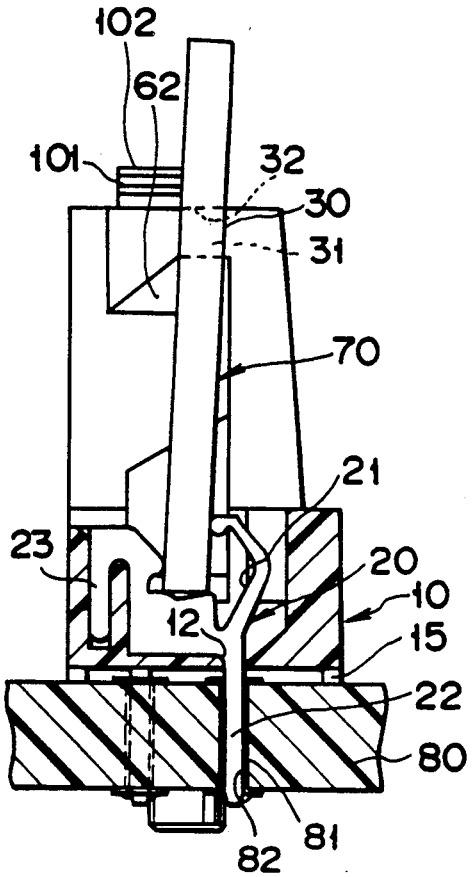

As is shown in FIGS. 4 and 5, the contact 20 has a groove 21. The lower end of a circuit board 70 (e.g., a printed board) is first inserted slantwise and downward into the groove 21. Then, the board 70 is rotated by about 45 degrees in the direction of the arrow shown in FIG. 4, such that the pattern formed on the lower end of the board 70 elastically contacts the contact 20 when the board 70 takes an upright position. The contact 20 has a fixing portion 23, and two rows of terminals 22, each projecting downward from the bottom of the fixing portion 23. The first low of terminals 22 extends parallel to the row of fixing portions 23, and located on the right side thereof. The terminals 22 of the second row are arranged in staggered fashion with respect to the terminals 22 of the first row.

It will now be described how the card-edge connector is used in combination with a substrate 80, with reference to FIGS. 4 and 5. The substrate 80 has two rows of through holes 81. These holes 81 are arranged in the same pattern as the terminals 22 of the connector. In other words, the holes 81 of one row are arranged in staggered fashion with respect to the holes 81 of the other row. The surface of each through hole 81 is covered with a conductive layer 82. In use, the connector is mounted on the substrate 80, with the terminals 22 fitted in the holes 81 of the substrate 80, whereby the terminals 22 are electrically connected to the conductive layers 82.

The first lift preventing means 30 comprises an engaging projection 31 horizontally extending at the top of the circuit-board holding member 13 and a circular engaging hole 32 which is formed in one end portion of the circuit board 70 and in which the engaging projection 31 is inserted. Likewise, the second lift preventing means 40 comprises an engaging projection 41 horizontally extending at the top of the circuit-board holding member 14 and a circular engaging hole 42 which is formed in the other end portion of the circuit board 70 and in which the engaging projection 41 is inserted.

The first locking member 50 is vertically provided at the vicinity of one end of the circuit-board insertion groove 11 of the housing 10 and has an engaging step portion 51 which has a triangular cross section and faces the circuit-board holding member 13 to engage the corresponding end of the circuit board 70. The engaging step portion 51 has an inclined surface 52. The engaging step portion 51 and the circuit-board holding member 13 prevent the circuit board 70 from moving back and forth, leftward and rightward. The second locking member 60 is vertically provided at the vicinity of the other end of the circuit-board insertion groove 11 of the housing 10 and has an engaging step portion 61 which has a triangular cross section and faces the circuit-board holding member 14 to engage the corresponding end of the circuit board 70. The engaging step portion 61 has an inclined surface 62. The engaging step portion 61 and the circuit-board holding member 14 prevent the circuit board 70 from moving back and forth, leftward and rightward.

The first operating member 90 has a plate form and is integrally formed with the locking member 50 so as to extend outward from the upper portion thereof in an upwardly inclined manner. The body 92 of the first operating member 90 has a curved operating surface which is provided with slip preventing grooves 91 for preventing a thumb of the user from slipping therefrom when he removes the circuit board 70 from the housing 10 of the connector. Likewise, the second operating member 100 has a plate form and is integrally formed with the locking member 60 so as to extend outward from the upper portion thereof in an upwardly inclined manner. The body 102 of the first operating member 100 has a curved operating surface which is provided with slip preventing grooves 101 for preventing the other thumb of the user from slipping therefrom when he removes the circuit board 70 from the housing 10 of the connector. The operating members 90 and 100 are used to broaden the space between the locking members 50 and 60 to unlock the circuit board 70 when the circuit board 70 is to be removed from the connector.

On the undersurface of the housing 10 which is fixed to the substrate 80 are formed a plurality of projections 15 for hindering solder and flux from rising. The housing 10 has a circuit-board positioning portion 16 at the central portion of the circuit-board insertion groove 11 and is provided at the outside of the locking members 50 and 60 with stops 17 for preventing the locking members 50 and 60 from being bent and curved.

Figure 2:
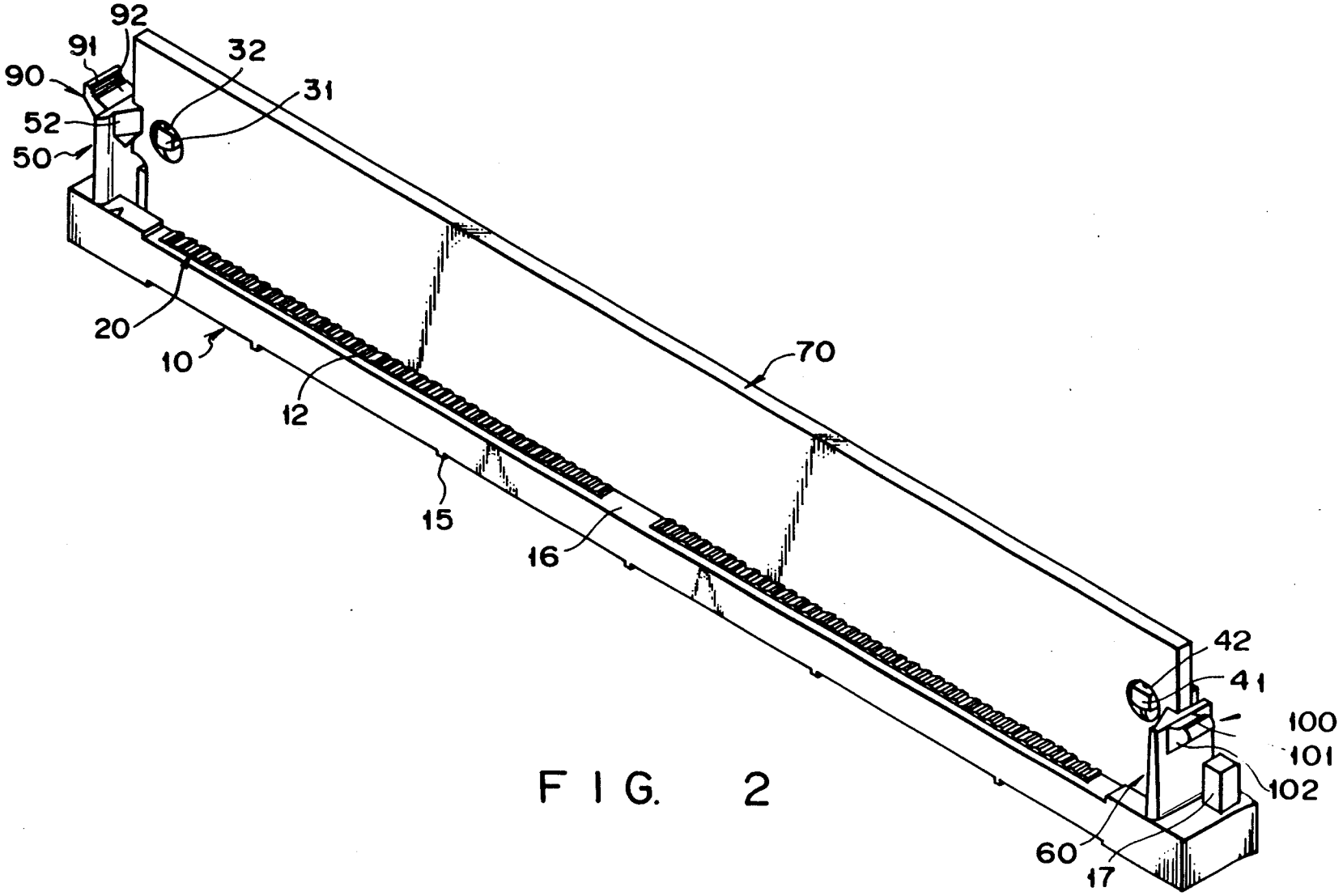
FIG. 2 is a perspective view of the first embodiment in which a circuit board is inserted therein.
Figure 3:
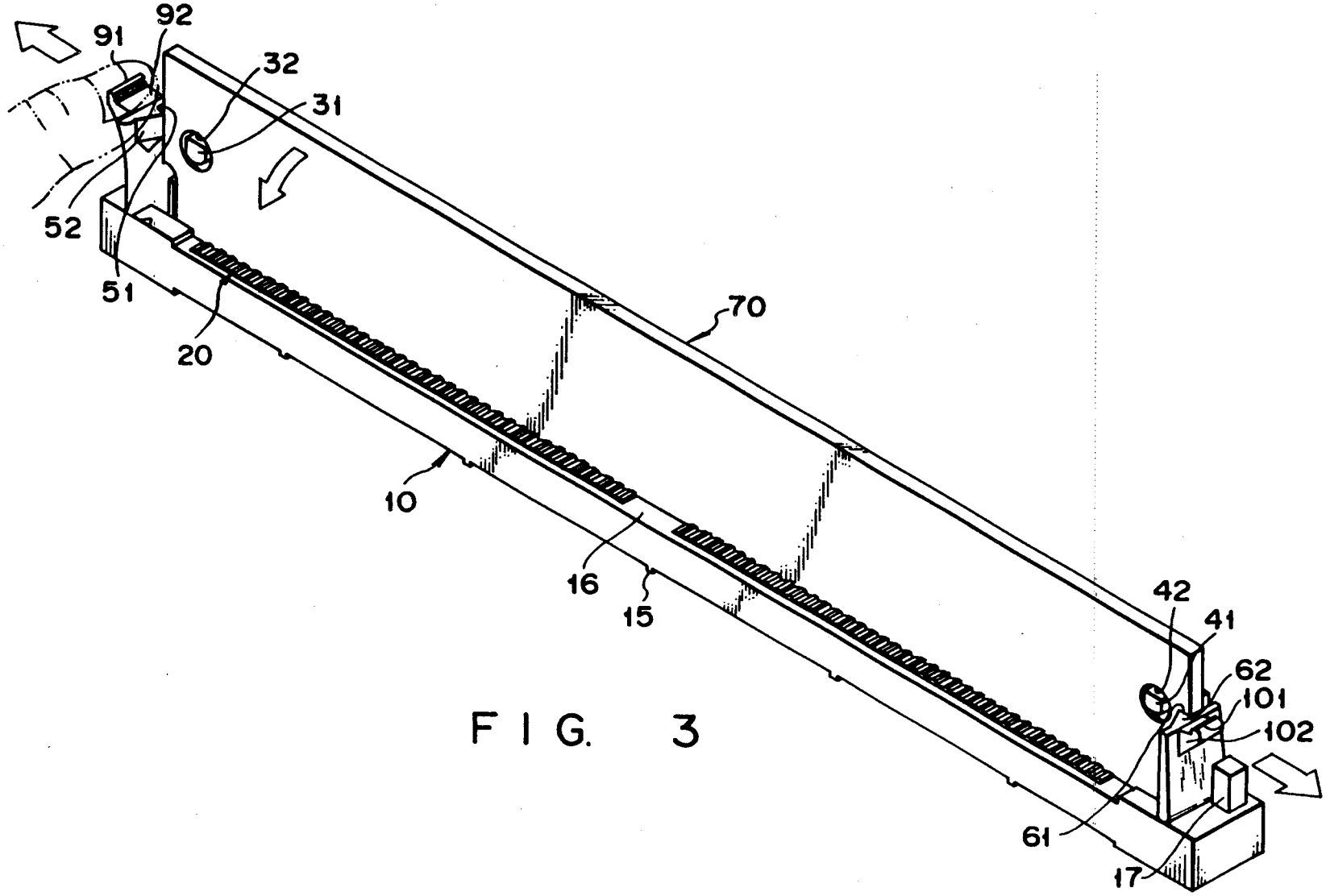
FIG. 3 is a perspective view of the first embodiment, illustrating how the circuit board is removed from the housing

In the connector as constructed above is removably inserted the circuit board 70 formed with predetermined circuit patterns (not shown) by means of, for example, printing. The lower end portion of the circuit board 70 is provided with a circuit pattern connecting portion which is electrically connected to the fixing portion 23 of the contact 20. In order to insert the circuit board 70 in the housing 1 of the connector, the circuit board 70 is slantwise inserted in the contact groove 21 from the above and is turned clockwise through approximately 45 degrees, as shown in FIG. 4. Then, the circuit board 70 is rotated along the inclined surfaces 52 and 62 of the locking members 50 and 60. After the locking members 50 and 60 have been curved outward, the ends of the circuit board 70 engage the engaging step portions 5 and 61, and the engaging projections 31 and 41 are inserted in the engaging holes 32 and 42 of the circuit board 70. FIGS. 2, 3 and 5 show the state in which the circuit board 70 is set in the connector.

Since the engaging projection 31 is inserted in the engaging hole 32 and the engaging projection 41 is inserted in the engaging hole 42, the circuit board 70 is prevented from being lifted such that the circuit board 70 is kept in electrical contact with the contact 20. Further, the engagement of both ends of the circuit board 70 with the engaging step portions 51 and 61 and the abutment of the plate surface of the circuit board 70 against the circuit-board holding member 1 hinder the circuit board 70 from moving back and forth, leftward and rightward.

Figure 8:
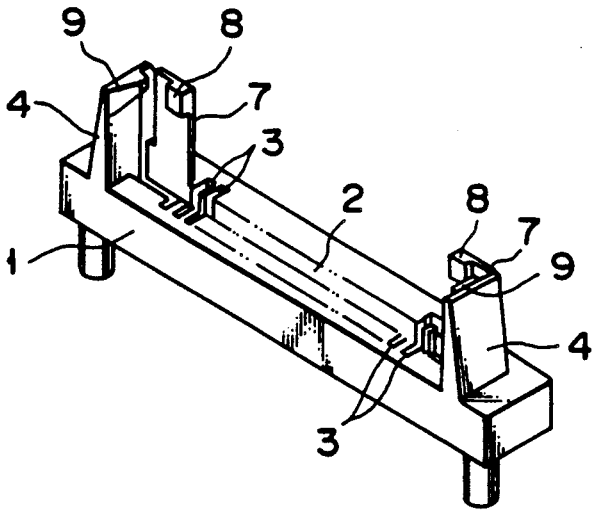
PRIOR ART FIG. 8
FIG. 8 is a perspective view of an example of the conventional card-edge connector.

As shown in FIG. 3, the bodies 92 and 102 of the operating members 90 and 100 are bent outward by pushing downward the operating members 90 and 100 at the grooves 91 and 101 by the user with the thumbs such that both ends of the circuit board 70 are disengaged from the engaging step portions 51 and 61. By holding this state, the circuit board 70 is rotated in the clockwise direction whereby the circuit board 70 is easily removed from the housing 10. With the conventional connector as shown in FIG. 8, the locking pieces 4 must be forcibly pushed outward by the user with the nails or a tool such as a driver as mentioned above. With the connector of this invention, however, it is unnecessary for the user to employ his nails or any tool to remove the circuit board 70 from the connector, ensuring easier and safer removal of the circuit board 70 from the connector.

Figure 6:
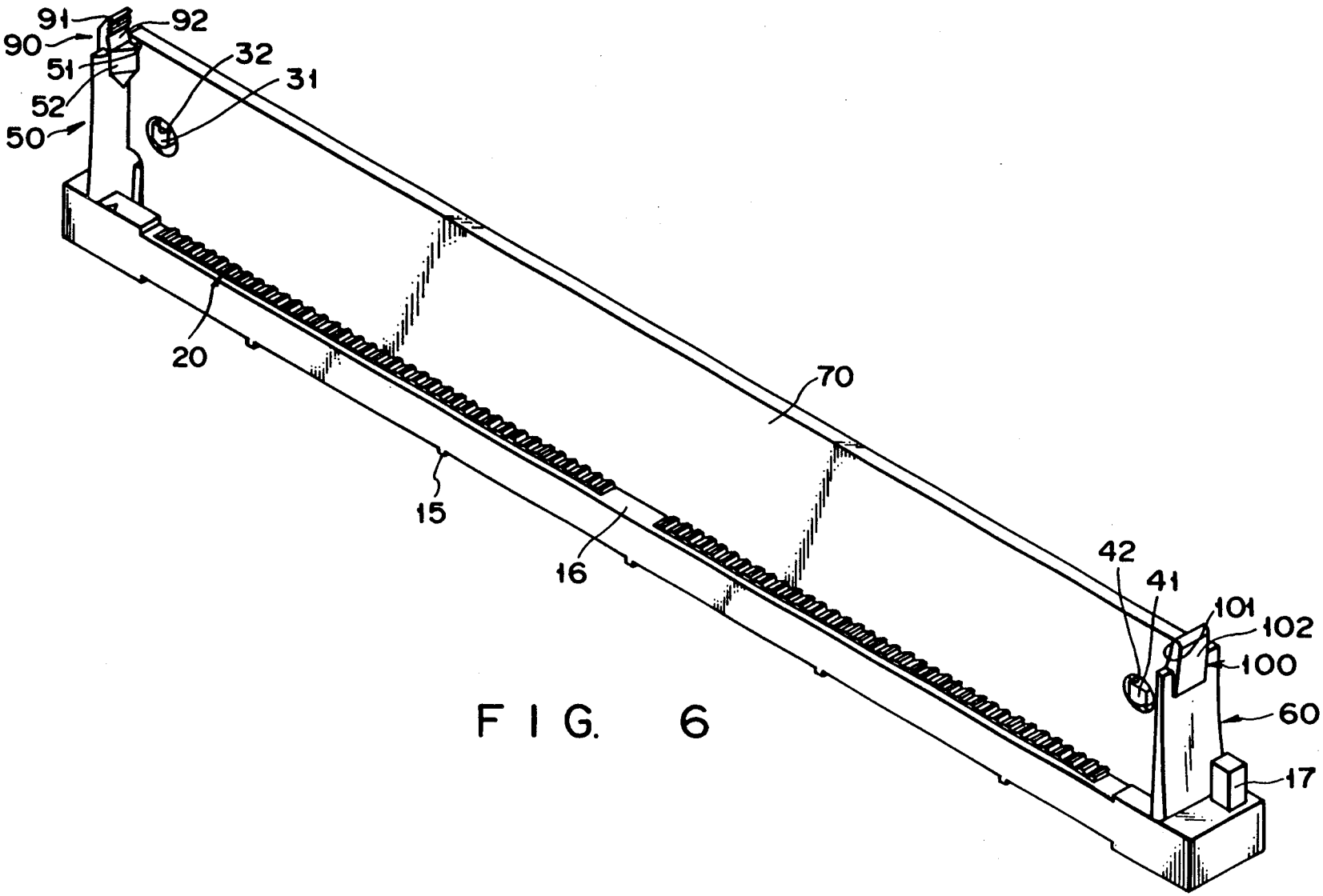
FIG. 6 is a perspective view of a second embodiment of the card-edge connector according to this invention.

FIG. 6 is a perspective view of the second embodiment of the connector according to this invention. Locking members 50 and 60 are integrally formed at their upper portions with operating members 90 and 100 which extend substantially vertically. With this arrangement, the circuit board 70 can be removed from the connector at a relatinvely nnarrow space.

Figure 7:
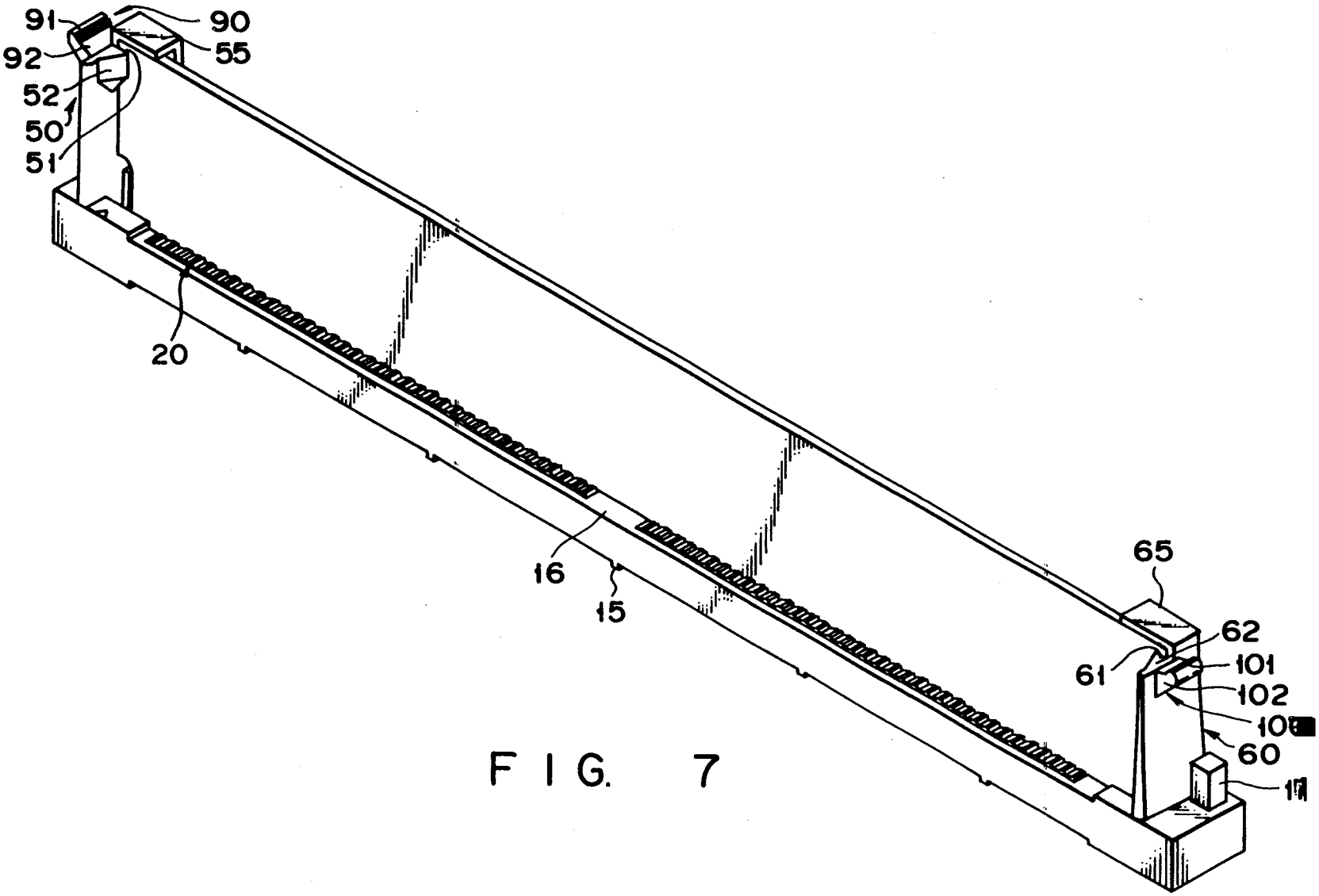
FIG. 7 is a perspective view of a third embodiment of the card-edge connector according to this invention.

FIG. 7 is a perspective view of the third embodiment of this invention. With this embodiment, locking members 50 and 60 are integrally formed at their upper ends with substantially L-shaped members 55 and 56 as lift preventing means of a circuit board 70 which hold the corners of the circuit board 70, in place of the lift preventing means 30 and 40 which comprise the engaging holes 32 and 42 formed in the circuit board 70 and the engaging projections 31 and 41 formed on the upper portions of the circuit-board holding members 30 and 40 of the first and second embodiments of this invention. Thus, the third embodiment has a simpler structure than the other embodiments.

What is claimed is:

1. A card-edge connector comprising:

a a housing having a wall;

a circuit-board insertion-groove formed in said wall for receiving a circuit board, and having first and second ends;

a plurality of holes formed in said wall and adjacent to said groove;

a plurality of contacts arranged in said holes and groove, said contacts being formed such that said circuit board can be inserted from above at an angle, and also can be rotated through a predetermined angle to standard perpendicularly after insertion, where said contact is electrically connected to a circuit pattern of said circuit board;

first and second circuit-board supporting-members arranged in said first and second ends of said groove, respectively, for supporting said circuit board perpendicular;

first and second lift-preventing means, arranged in said first and second ends of said groove, respectively, for preventing said circuit board from lifting from said groove;

first and second locking members integrally implanted in said wall and in the vicinity of said first and second ends of said groove, respectively, in order to prevent said circuit board from moving back and forth, left and right, said first and second locking members being elastically deformable along said groove, and having engaging stepped-portions opposed to said first and second supporting members, respectively; and operating members, formed integral with respective tip portions of said first and second locking members for broadening a space between said tip portions of said first and second locking members when said circuit board is removed from said groove and said contacts.

2. The card-edge connector according to claim 1, wherein each of said locking members has an upper portion, and each of said operating members has a plate shape and is integrally formed on said upper portion of the respective locking member so as to incline upward and outward of said housing.

3. The card-edge connector according to claim 1, wherein each of said operating members has a curved operating surface and slip preventing grooves.

4. The card-edge connector according to claim 1, wherein each of said circuit-board holding members has a lateral wall face, and each of said lift preventing means comprises an engaging hole formed in said circuit board and an engaging projection extending from said lateral wall face of the respective circuit-board holding member and inserted in said engaging hole.

5. The card-edge connector according to claim 1, wherein each of said locking members has an upper portion, and each of said lift preventing means has a substantially L-shaped member provided on said upper portion of the respective locking member so as to hold corners of said circuit board.

6. The card-edge connector according to claim 1, wherein said housing has a substrate side face and projections formed on said substrate side face for preventing solder and flux from rising.

7. The card-edge connector according to claim 1, wherein said housing has a circuit-board positioning portion formed at an central portion thereof.

* * * * *